US009629410B2

(12) United States Patent
Perreault et al.

(10) Patent No.: US 9,629,410 B2
(45) Date of Patent: Apr. 25, 2017

(54) ANTI-PINCH APPAREL CLOSURE

(75) Inventors: Jesse Perreault, Madison, WI (US); David J. Schofield, Delavan, WI (US); Scott D. Kolasa, Mount Prospect, IL (US)

(73) Assignee: Trek Bicycle Corporation, Waterloo, WI (US)

( * ) Notice: Subject to any disclaimer, the term of this patent is extended or adjusted under 35 U.S.C. 154(b) by 0 days.

(21) Appl. No.: 13/210,958

(22) Filed: Aug. 16, 2011

(65) Prior Publication Data

US 2013/0042445 A1 Feb. 21, 2013

(51) Int. Cl.

| | |
|---|---|
| ***A44B 11/25*** | (2006.01) |
| ***B23P 11/00*** | (2006.01) |
| ***A42B 3/08*** | (2006.01) |

(52) U.S. Cl.

CPC ..... *A42B 3/08* (2013.01); *Y10T 24/45534* (2015.01); *Y10T 29/49826* (2015.01)

(58) Field of Classification Search

CPC .... A42B 3/08; A42B 3/00; A42B 3/06; A42B 3/0473; A42B 3/085; A42B 3/12; A42B 3/063; A44B 11/12; A44B 11/266; A44B 11/263; A44B 11/006; A44B 11/14; A44B 11/06; A45D 44/00; A45D 44/22; Y10T 24/45534

USPC ... 24/614, 615, 616, 627, 625, 630, 265 EC, 24/265 BC; 2/421

See application file for complete search history.

(56) References Cited

U.S. PATENT DOCUMENTS

| | | | | |
|---|---|---|---|---|
| 407,860 | A | | 7/1889 | Grumbach |
| 874,957 | A | | 12/1907 | Godley |
| 1,079,080 | A | | 11/1913 | Ward |
| 1,539,744 | A | | 5/1925 | Kelly |
| 2,565,123 | A | * | 8/1951 | De Mar ..... 128/97.1 |
| 3,608,158 | A | | 9/1971 | Bengtsson |
| 3,628,190 | A | * | 12/1971 | Molitoris ..... A42B 3/10 2/418 |
| 4,662,040 | A | | 5/1987 | Terrell et al. |
| 4,672,725 | A | | 6/1987 | Kasai |
| 4,713,865 | A | | 12/1987 | Geldwerth |
| 4,745,667 | A | | 5/1988 | Conte |
| 4,796,336 | A | | 1/1989 | Scully |
| 4,831,694 | A | | 5/1989 | Kong |
| 4,897,888 | A | | 2/1990 | Broersma et al. |
| 4,912,950 | A | | 4/1990 | Crowle |
| 4,991,272 | A | | 2/1991 | Bianchi |
| 5,012,533 | A | | 5/1991 | Raffler |

(Continued)

FOREIGN PATENT DOCUMENTS

| | | | |
|---|---|---|---|
| DE | 102008020947 | A1 | 10/2009 |
| GB | 2262962 | A | 7/1993 |

(Continued)

*Primary Examiner* — Robert J Sandy
*Assistant Examiner* — Rowland Do

(57) ABSTRACT

A buckle closure assembly having a male part and a female part that snap-fittingly cooperate with one another. The male part and the female part selectively interact with one another along an operating direction to connect and disconnect alternate portions of a strap system. One or both of the male part and the female part include an offset or a standoff that extends from the respective part in a crossing direction relative to the operating direction to maintain a spacing between the buckle assembly and adjacent anatomy and/or clothing.

20 Claims, 4 Drawing Sheets

(56) References Cited

U.S. PATENT DOCUMENTS

| | | | | |
|---|---|---|---|---|
| 5,086,547 | A | 2/1992 | Ziemelis | |
| 5,123,121 | A | 6/1992 | Broersma | |
| 5,131,122 | A | 7/1992 | Lavoto | |
| 5,144,725 | A | 9/1992 | Krauss | |
| 5,222,279 | A | 6/1993 | Frano et al. | |
| D341,105 | S | 11/1993 | Lovato | |
| 5,291,638 | A | 3/1994 | Huang | |
| 5,419,020 | A | 5/1995 | Murai | |
| 5,469,583 | A | 11/1995 | Akeley et al. | |
| 5,551,094 | A | 9/1996 | Navone | |
| 5,638,551 | A | 6/1997 | Lallemand | |
| 5,659,900 | A | 8/1997 | Arney et al. | |
| 5,704,072 | A | 1/1998 | Garneau | |
| 5,729,877 | A | 3/1998 | Kong et al. | |
| 5,774,901 | A | 7/1998 | Minami | |
| 5,983,405 | A | 11/1999 | Casale | |
| 6,159,324 | A | 12/2000 | Watters et al. | |
| 6,226,802 | B1 | 5/2001 | Sasaki et al. | |
| 6,279,168 | B1 * | 8/2001 | Bean | A42B 1/248 2/195.1 |
| 6,292,952 | B1 | 9/2001 | Watters et al. | |
| D452,834 | S | 1/2002 | Ko | |
| 6,351,876 | B1 | 3/2002 | Uehara | |
| 6,532,602 | B2 | 3/2003 | Watters et al. | |
| 6,722,544 | B1 | 4/2004 | Stephens et al. | |
| 6,826,806 | B2 | 12/2004 | Eaton et al. | |
| 6,854,133 | B2 | 2/2005 | Lee et al. | |
| 6,912,736 | B2 | 7/2005 | Moeller et al. | |
| 7,069,601 | B1 | 7/2006 | Jacobsen | |
| 7,111,329 | B2 | 9/2006 | Stroud et al. | |
| 7,140,049 | B2 | 11/2006 | Lang-Ree et al. | |
| 7,152,253 | B2 * | 12/2006 | Abelman | A42B 3/08 2/421 |
| 7,178,175 | B2 | 2/2007 | Rogers et al. | |
| 7,203,972 | B2 | 4/2007 | Pietrzak et al. | |
| 7,222,374 | B2 | 5/2007 | Musal et al. | |
| 7,246,383 | B2 | 7/2007 | Musal | |
| D560,551 | S * | 1/2008 | Uehara et al. | D11/216 |
| 7,350,277 | B1 | 4/2008 | Canfield et al. | |
| 7,360,283 | B2 | 4/2008 | Yu | |
| 7,461,527 | B2 | 12/2008 | Yu | |
| 7,600,268 | B2 * | 10/2009 | Rogers | A42B 3/08 2/6.6 |
| 7,900,279 | B2 * | 3/2011 | Kraemer et al. | 2/425 |
| 8,056,151 | B2 * | 11/2011 | Bologna et al. | 2/421 |
| 9,095,182 | B1 * | 8/2015 | Rochholz | A42B 3/08 |
| 2002/0083562 | A1 * | 7/2002 | Lerra | 24/115 G |
| 2003/0121130 | A1 * | 7/2003 | Buscart et al. | 24/615 |
| 2003/0221245 | A1 | 12/2003 | Lee et al. | |
| 2004/0098793 | A1 | 5/2004 | Gershenson | |
| 2006/0117466 | A1 * | 6/2006 | Abelman | A42B 3/08 2/421 |
| 2007/0004210 | A1 | 1/2007 | Takemiya et al. | |
| 2007/0083986 | A1 * | 4/2007 | Kaiser | 2/410 |
| 2007/0157372 | A1 | 7/2007 | Musal et al. | |
| 2009/0064466 | A1 * | 3/2009 | Henderson et al. | 24/190 |
| 2009/0133183 | A1 | 5/2009 | Burek et al. | |
| 2009/0178251 | A1 * | 7/2009 | Yang | 24/625 |
| 2011/0094018 | A1 * | 4/2011 | Rogers et al. | 2/421 |

FOREIGN PATENT DOCUMENTS

| | | |
|---|---|---|
| WO | WO 93/01732 | 2/1993 |
| WO | WO 2006/110077 A1 | 10/2006 |

* cited by examiner

ANTI-PINCH APPAREL CLOSURE

BACKGROUND OF THE INVENTION

The present invention relates to a quick connect apparel closure assembly, commonly referred to as a snap buckle, usable on apparel such as bicycle helmets and the like and is constructed to prevent the inadvertent compression of skin or tissue during operation of the buckle.

Many items of apparel are commonly provided with various closure assemblies including zippers, snaps, and buckles. Each of these various closure assemblies has various applications. Head apparel, such as helmets, are commonly provided with buckle assemblies that interconnect respective ends of a strap system that secures the helmet to the head of a wearer. Commonly, such buckles are constructed for single handed operation and/or convenient operation such that capable children can conveniently operate the buckle closure. Such helmets are common in work and sport environments wherein the wearer's head is intended to be protected from incidental or accidental contacts or impacts. It is not uncommon for individuals to wear protective helmets or headgear when riding bicycles, horseback riding, skiing, snowboarding, skating, or when engaged in other sporting activities such as football, baseball, hockey, skating, etc. Such protective headgear is also common in many industrial environments such as foundry, forestry, mining, construction, and other industrial and commercial endeavors.

Many of the snap buckles associated with such head gear commonly include a male portion and a female portion that slidably cooperate with one another. Once fully translated relative to one another in the operating direction, a spring tab or other latch mechanism commonly snap fittingly cooperates with a catch so as to positionally secure the first buckle portion relative to the second buckle portion. Subsequent user interaction with at least one of the latch mechanism or the catch is required to effectuate disengagement of the first and second buckle portions from one another. Many such buckle systems are selectively operable by concurrent user interaction with a pair of spring tabs positioned on generally opposite lateral sides of the buckle. Two or single handled pinching action by the user compresses both spring tabs toward a position wherein the respective portions of the buckle assembly can be disengaged from one another. Both the slidable interaction of the buckle portions and the pinching interaction to effectuate operation of the latching mechanism presents the undesirable potential for pinching the users skin or tissue as the first and second buckle portions are introduced into one another or by the inadvertent inclusion of skin between the tabs and the fingers of the wearer during manipulation of the latch and/or catch mechanisms.

Although most adult users can visually inspect a buckle system and readily assess the operation of the same to minimize the potential of undesired pinching, even most adults are susceptible to hurried or somewhat inattentive operation of the buckle system and the resultant pinching. Adult manipulation of such buckle assemblies on those who cannot effectively operate the buckle systems, such as younger children, presents the same undesirable pinching potential to a child during adult manipulation of the buckle portions and/or the latch or catch systems.

Others having recognized the shortcomings discussed above provide buckle systems have elongated guide portions that extend from either of the first or second portion of the buckle to provide and overlapping arrangement of the first and second portions of the buckle to mitigate the pinch potential associated with the longitudinal operational translation of the first and second buckle portions. Such systems however do not address or otherwise resolve the inadvertent pinching of the users skin caused during operation of the latch or catch mechanism. Still others provide extraneous guards or shields that must be positionally associated with the buckle and extend in a generally planar manner from various sides of the buckle. Such guard systems are commonly formed of flexible materials, such as cloth, and are susceptible to slippage or undesired movement of the guard during use of the helmet. The flexible nature of the guard also presents the undesired possibility of pinching the skin or tissue of the wearer, not between the fingers of the user and the structure of the buckle, but between the fingers and underlying portions of the guard.

Another drawback of both such systems is the increased footprint associated with the guide or shield and the close proximity of such systems to the wearer. During many athletic and/or work related activities that require the wearer to exert themselves, supporting interaction with more rigid structures such as closure buckles can produce undesired discomfort and/or irritation to the wearer. Enlarged footprints or contact areas attributable to such structures can detract from wearer cooling attributable to perspiration and tend to exacerbate discomfort or irritation attributable to the closure assembly. When used in helmet applications, such considerations can be further exacerbated via their location about the head or face area of the wearer.

Accordingly, regardless of the shape and/or intended use of the item of apparel, there is a need for an apparel closure system that can be quickly and conveniently operated by a user and in a manner that mitigates at least one or more of the pinching concerns discussed above. There is a further need for such an apparel closure system that mitigates the pinching aspects and does not unduly cover or interact with portions of the wearer.

SUMMARY OF THE INVENTION

The present invention provides an apparel closure buckle that addresses one or more of the shortcoming discussed above. The buckle closure includes a male part and a female part that snap-fittingly cooperate with one another. The male part and the female part selectively interact with one another along an operating direction to connect and disconnect alternate portions of a strap system. One or both of the male part and the female part include an offset or a standoff that extends from the respective part in a crossing direction relative to the operating direction to maintain a spacing between the buckle assembly and adjacent anatomy and/or clothing.

Another aspect of invention useable with one or more of the above aspects discloses an apparel closure assembly having a first body and a second body that slidably cooperate with one another. A cavity and at least one opening are formed in the first body such that the at least one opening extends through the first body in an outward radial direction from the cavity. A portion of the second body is constructed to slidably cooperate with the cavity formed in the first body. A spring tab is connected to the second body by a living hinge and biased into engagement with the opening formed in the first body when the portion of the second body is disposed in the cavity. A standoff extends from one of the first body and the second body in an outward direction that is oriented in a crossing direction with respect to a movement direction of the spring tab and maintains a spacing between the first body, the second body, and the wearer.

Another aspect of the invention that is useable with one or more of the aspects described above discloses a snap buckle assembly having a first buckle portion and a second buckle portion. The second buckle portion slidably cooperates with the first buckle portion. A catch is flexibly connected to the second buckle portion and deflectable relative to the second buckle portion in a direction that crosses an operating direction associated with slidable cooperation between the first buckle portion and the second buckle portion. The catch is biased toward a secured engagement with the first buckle portion when the second buckle portion is fully engaged with the first buckle portion. An offset extends from one of the first buckle portion and the second buckle portion in a direction that crosses both a deflection direction of the catch and the operating direction of the first and second buckle portions.

Another aspect of the invention that is usable with one or more of the above aspects discloses a method of forming a pitch resistant snap buckle assembly. A first clasp is attached to a strap and a second clasp is attached to at least one of the strap and another strap. A tab is formed on one of the first clasp and the second clasp and a pocket is formed on the other of the first clasp and the second clasp. The tab and the pocket are oriented so that the first clasp and second clasp snap-fittingly cooperate with one another to selectively connect the first clasp and the second clasp. A projection extends from at least one of the first clasp and the second clasp to form a gap between the first clasp and the second clasp and a wearer.

Preferably, the closure or buckle assemblies and method of forming a snap buckle assembly as described in the aspects above is applicable to various items of apparel including but not limited to bicycle helmets.

These and various other aspects and features of the present invention will be better appreciated and understood when considered in conjunction with the following detailed description and the accompanying drawings. It should be understood that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

The drawings illustrate one preferred embodiment presently contemplated for carrying out the invention. In the drawings.

Figure 1:
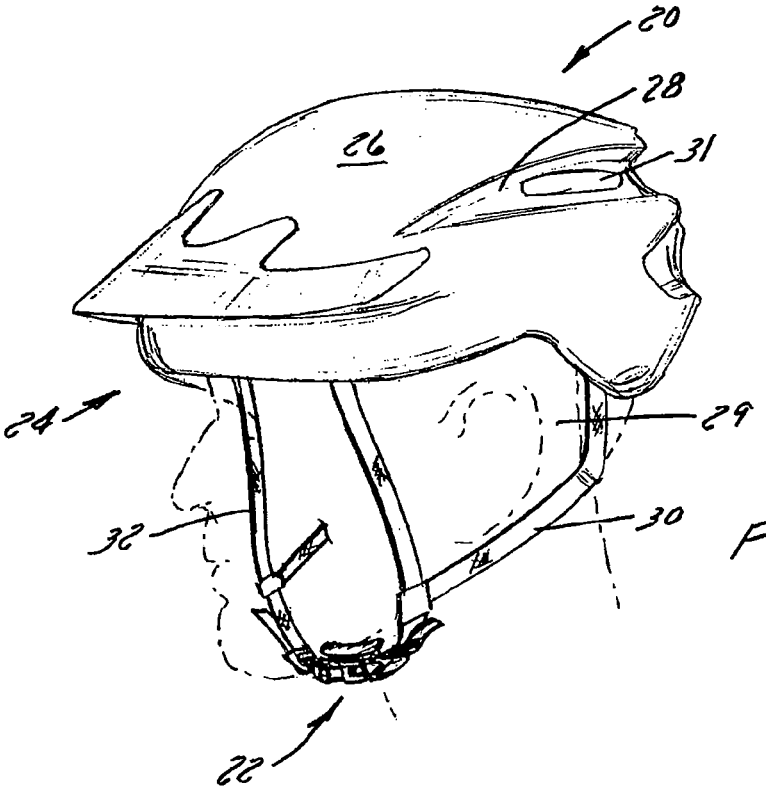
FIG. 1 is a side perspective view of a bicycle helmet equipped with a strap and buckle assembly according to the present invention.
Figure 2:
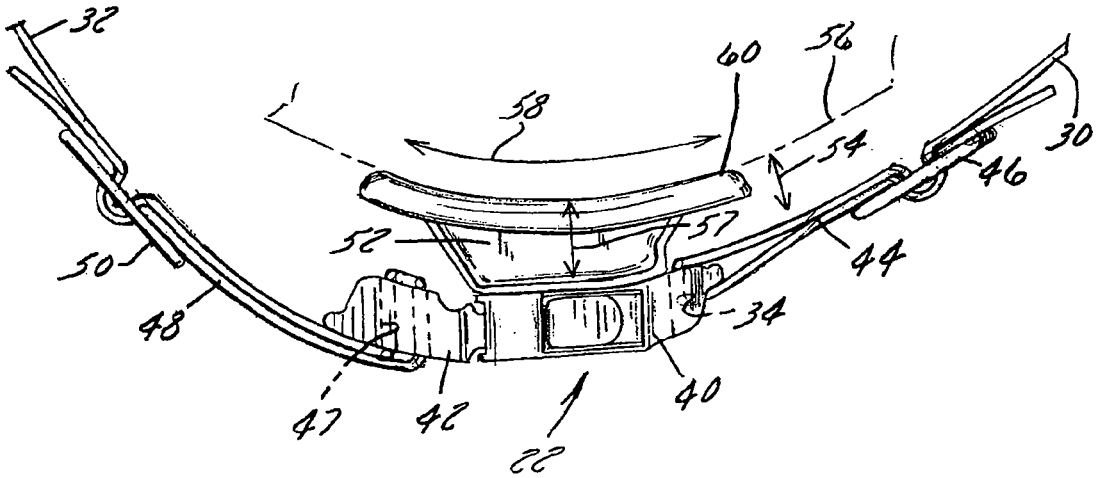
FIG. 2 is a elevation view of the buckle and strap assembly shown in FIG. 1.

In describing the preferred embodiments of the invention that are illustrated in the drawings, specific terminology will be resorted to for the sake of clarity. However, it is not intended that the invention be limited to the specific terms so selected and it is to be understood that each specific term includes all technical equivalents that operate in a similar manner to accomplish a similar purpose. For example, the word "connected," "attached," or terms similar thereto are often used. They are not limited to direct connection but include connection through other elements where such connection is recognized as being equivalent by those skilled in the art.

DETAILED DESCRIPTION OF THE PREFERRED EMBODIMENT

FIG. 1 shows an exemplary helmet 20, such as a bicycle helmet, equipped with a snap, closure, or buckle assembly 22 according to the present invention. Helmet 20 includes a downward facing opening 24 that is generally defined by a body 26 of helmet 20. Body 26 includes one or more channels 28 and openings 31 that are shaped and positioned to facilitate the flow of air over and around the head of the wearer both over and under the helmet. Opening 24 is generally shaped to non-interferingly accept the crown or top portion of a wearer's head 29. A net or one or more straps 30, 32 are secured to the interior portion of helmet 20 and extend downward therefrom. Buckle assembly 22 is secured to straps 30, 32 and provides a selectively operable connection in the strap system such that the straps can extend about the cheeks and/or ear area and generally below the chin of a wearer to secure helmet 20 to the head 29 of a user.

Although buckle assembly 22 is shown as being configured to cooperate with a bicycle helmet, it is appreciated that buckle assembly 22 can be provided in a number of form factors to tolerate incorporation into other items of apparel. That is, it is envisioned that buckle assembly 22 can also be configured to provide a convenient, secure, and repeatable closure assembly for forming a closure assembly of other items of apparel where pinching of the wearer is possible and/or helmets suitable for other activities.

As shown in FIGS. 2-5, buckle assembly 22 includes a first body, clasp, or first buckle portion 40 and a second body, clasp of buckle portion 42 that snap fittingly cooperate with one another to form a quick and convenient selectively connectable closure assembly. First strap 30 slidably cooperates with a loop opening 34 formed in first buckle portion 40. A portion 44 of first strap 30 overlaps itself and cooperates with a slide 46 that movably but securely cooperates with the overlapping portion 44 of strap 30 to variably define the length of strap 30 from helmet 20. Second strap 32 slidably cooperates with a loop opening 47 formed in second buckle portion 42. A portion 48 of second strap 32 also overlaps itself and also cooperates with a slide 50 to adjustably define the length of strap 32 between second buckle portion 42 and helmet 20. Although described as first and second straps, it is appreciated that straps 30, 32 could be provided as a singular strap wherein alternate ends of the single strap cooperate with respective portions of buckle assembly 22.

At least one of first buckle portion 40 and second buckle portion 42 include a projection, offset, or standoff 52 that extends from the respective buckle portion 40, 42 in a lateral direction, indicated by arrow 54, toward a user's skin or tissue surface 56 and maintains a gap 57 between a surface 56 of the wearer and the selectively severable operable portions of buckle assembly 22. Although shown as extending from first buckle portion 40 or a female or receiving portion of buckle assembly 22, it is appreciated that standoff 52 could alternatively be formed so as to extend from second buckle portion 42 or a male portion of the buckle assembly. Understandably, first buckle portion 40 would be constructed to accommodate the structure of the standoff in a bypassing manner and in a manner that maintains a separation between the skin of the wearer and the slidable interaction between the respective portions of such a buckle assembly. As explained further below, standoff 52 extends along a generally curvilinear longitudinal axis, indicated by arrow 58, and preferably includes an optional pad that is formed of a softer or more pliable material than the generally rigid plastic material of buckle portions 40, 42.

Figure 3:
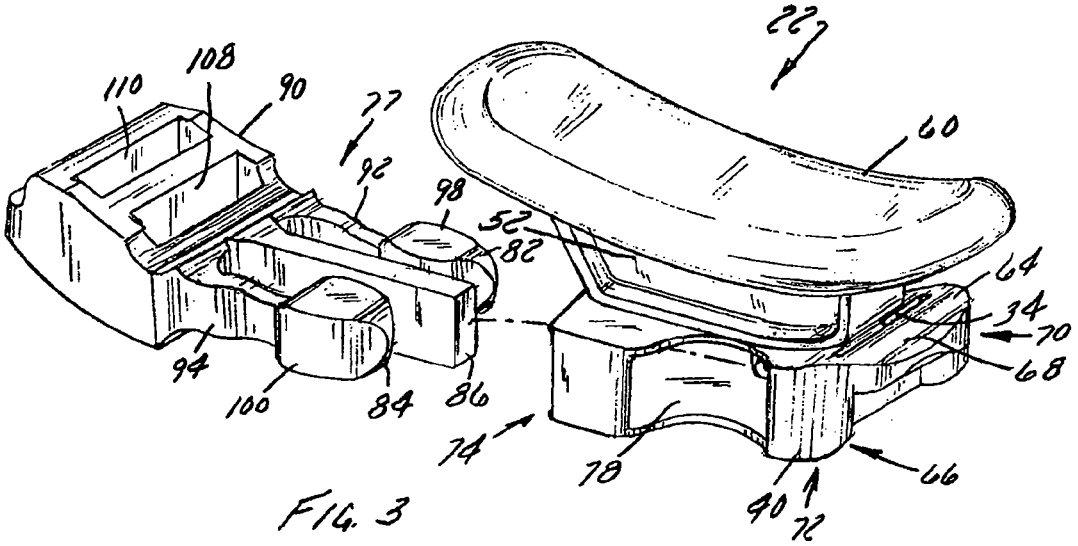
FIG. 3 is a perspective view of the buckle assembly shown in FIG. 2 with a first buckle portion disengaged from a second buckle portion.
Figure 4:
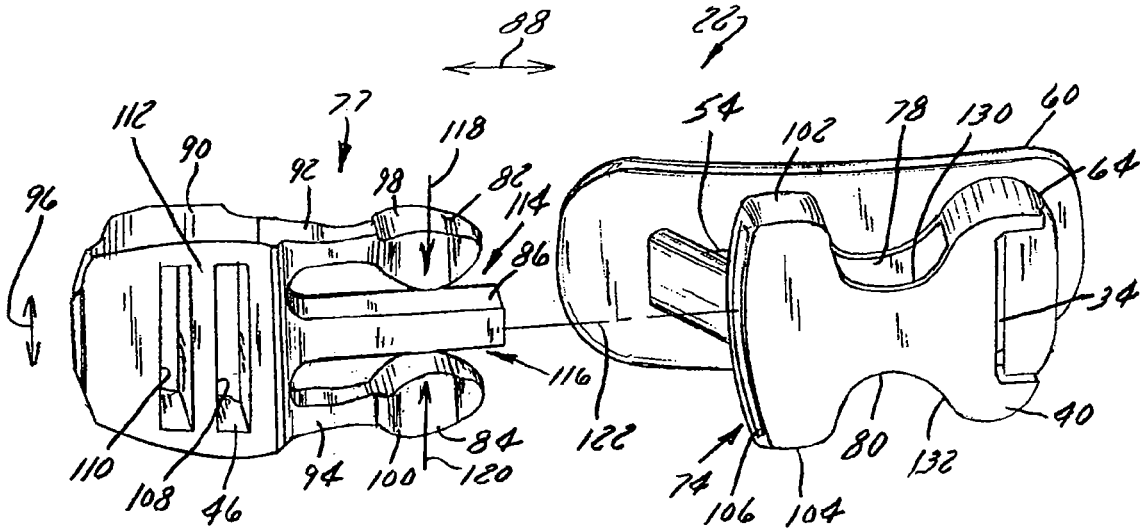
FIG. 4 is another perspective view of the buckle assembly shown in FIG. 3.

Referring to FIGS. 3 and 4, first buckle portion 40 and standoff 52 are preferably formed as a one-piece body 64. Loop opening 34 is formed at a strap end 66 of first buckle portion 40 and defined by a strap wall 68 that extends between opposite lateral sides 70, 72 of first buckle portion 40. A cavity or pocket 74 is formed in body 64 at an end 76 of body 64 generally opposite strap end 66 or the end of body 64 that faces second buckle portion 42. As explained further below, pocket 74 of first buckle portion 40 is constructed to slidably and selectively securely cooperate with an engagement end 77 of second buckle portion 42.

Still referring to FIGS. 3 and 4, first buckle portion 40 includes a pair of lateral openings 78, 80 that are in fluid communication with pocket 74 and are exposed to atmosphere. Openings 78, 80 are constructed to accommodate a respective spring tab, catch, or simply a tab 82, 84 associated with engagement end 77 of second buckle portion 42.

Second buckle portion 42 includes a loop opening 47 that is defined by a first opening 108 and a second opening 110 formed in body 90 and separated by a wall 112. As is commonly understood, openings 108, 110 and wall 112 allow for slidable interaction of second buckle portion 42 and strap 32. With respect to operating end 77 of second buckle portion 42, a stem 86 extends in a longitudinal or operating direction, indicated by arrow 88, from second buckle portion 42 and is generally positioned between tabs 82, 84. Tabs 82, 84 are preferably integrally formed with a body 90 of second buckle portion 42 and pivotably connected to the body by a living hinge member or simple a hinge 92, 94. Hinges 92, 94 allow bidirectional lateral deflection, indicated by arrow 96, of tabs 82, 84 relative to stem 86.

Preferably, when at rest, hinges 92, 94 bias a head portion 98, 100 of each of tab 82, 84 into operative engagement with a catch, wall, or stop 102, 104 defined by first buckle portion 40. Each stop 102, 104 is formed between an opening 106 defined by pocket 74 and openings 78, 80 of first buckle portion 40. A space 114, 116 is formed between each head portion 98, 100 of tabs 82, 84 and stem 86 of second buckle portion 42. Spaces 114, 116 allow selective inward lateral translation, indicated by arrows 118, 120 of each head portion 98, 100 of tabs 82, 84 relative to a longitudinal axis, indicated by line 122, associated with longitudinal translation of first buckle portion 40 and second buckle portion 42 along operating direction 88.

Figure 5:
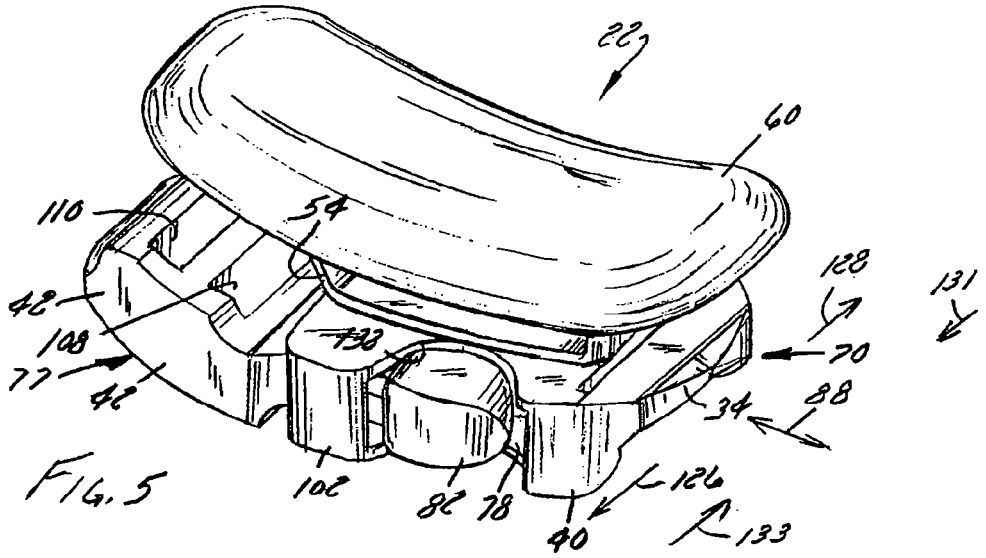
FIG. 5 is a view similar to FIG. 3 and shows the first buckle portion and the second buckle portion snap-fittingly engaged with one another such that user interaction is required to separate the respective buckle portions.
Figure 10:
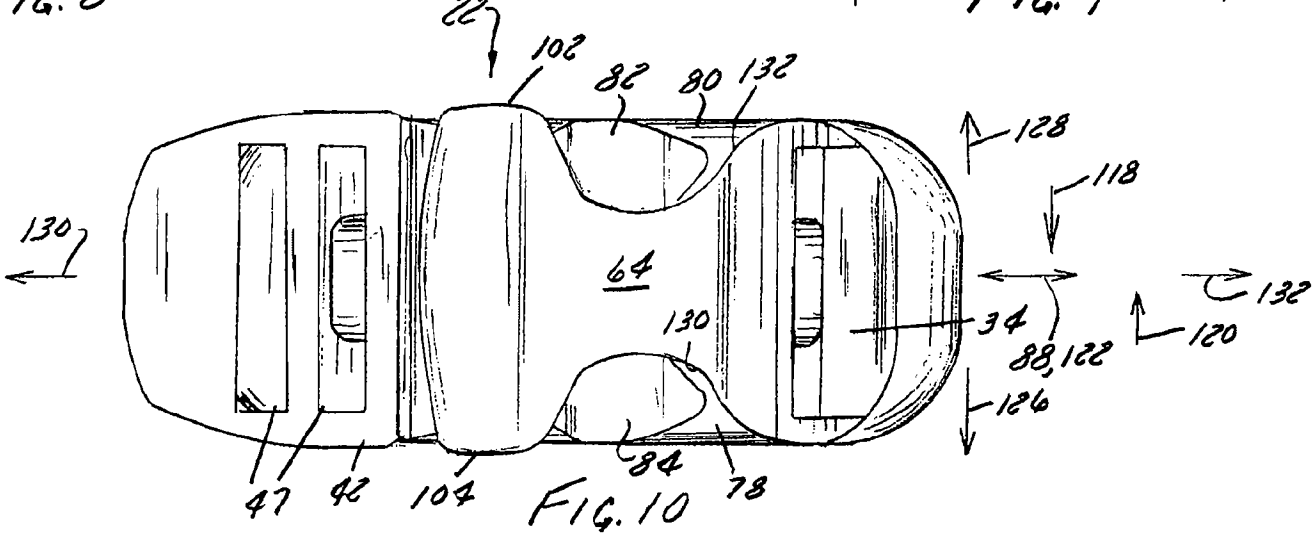
FIG. 10 is a bottom plan view of the buckle assembly shown in FIG. 5 that faces away from the wearer during use of the buckle assembly.

As shown best in FIGS. 5 and 10, when first buckle portion 40 and second buckle portion 42 are operatively engaged with one another, head portions 98,100 deflect inward thereby allowing slidable translation of first buckle portion 40 relative to second buckle portion 42 along operating direction 88. As is commonly understood, head portions 98, 100 and pocket 74 are contoured to allow the operative engagement between the first and second buckle portions 40, 42 without user interaction with tabs 82, 84.

During engagement between first and second buckle portions 40, 42, upon reaching openings 78, 80 head portions 98, 100 of tabs 82, 84, via hinges 92, 94, each automatically bias in a respective laterally outward direction, indicated by arrows 126, 128 so as to interferingly cooperate with stops 102, 104 of first buckle portion 40. Upon full engagement of second buckle portion 42 with pocket 74 of first buckle portion 40, the cooperation of head portions 98, 100 with openings 78, 80 commonly provides an audible indication, such as a click or a snap, associated with the longitudinal interfering engagement of head portions 98, 100 of second buckle portion 42 with a respective stop 102, 104 of first buckle portion 40. Without further user interaction, the respective interfering engagement between head portions 98, 100 of tabs 82, 84 of second buckle portion 42 with stops 102, 104 of first buckle portion 40 prevents longitudinal translation of first buckle portion 40 and second buckle portion 42 relative to one another in a disengagement or removal direction associated with operating direction 88.

Still referring to FIGS. 5 and 10, body 64 of first buckle portion 40 includes a pair of contours 130, 132 that are shaped to accommodate a user's fingertips to allow respective inward lateral deflection 118, 120 of each of head portions 98, 100 of tabs 82, 84. Head portions 98, 100 can deflect in the respective inward lateral direction, indicated by arrows 131, 133, a distance that is sufficient to allow disengagement of first buckle portion 40 from second buckle portion 42. Said in another way, the inward lateral deflection of tabs 82, 84 overcomes the normally interference biased orientation of head portions 98, 100 with stops 102, 104.

Figure 6:
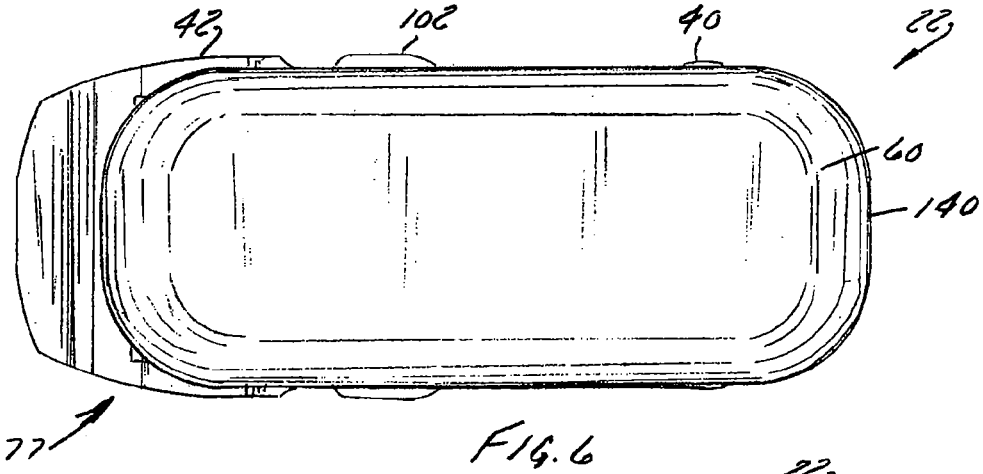
FIG. 6 is a plan view of a side of the buckle assembly shown in FIG. 5 that faces a wearer.
Figure 7:
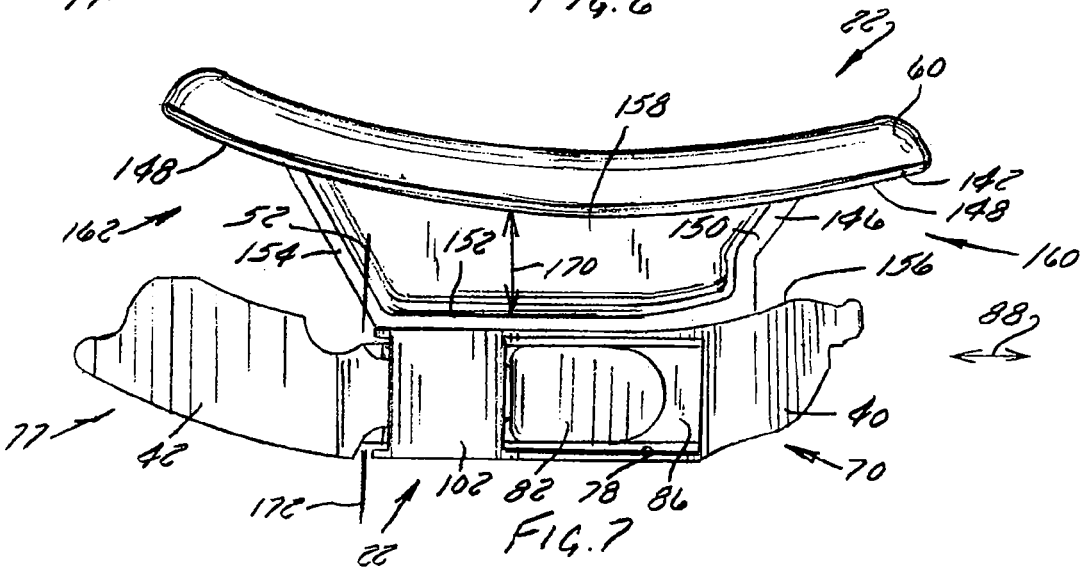
FIG. 7 is a side elevation view of a longitudinal side of the buckle assembly shown in FIG. 5.

Referring now to FIGS. 6 and 7, optional pad 60 includes a perimeter 140 that generally overlies a substantial portion of first buckle portion 40 and second buckle portion 42. Preferably, pad 60 or a user facing side of buckle assembly 22 has a footprint that is less than a footprint attributable to the interfering engagement of the combined first and second buckle portions 40, 42.

Optional pad 60 is secured to a user facing surface of a shoe 142 of standoff 52. Standoff 52 includes a rib 146 that includes a first portion 150, a second portion 152, and a third portion 154. First portion 150 of rib 146 extends from an underside 148 of shoe 142 of first buckle portion 40. Second portion 152 of rib 146 extends generally along a user facing side 156 of first buckle portion 40 in a direction generally aligned with operating direction 88. Like first portion 150, third portion 154 of rib 146 also extends from user facing side 156 of first buckle portion 42 to underside 148 of shoe 142. First rib portion 150 and third rib portion 154 are offset from one another with respect to operating direction 88 by the length of second rib portion 152.

Standoff 52 includes a web wall 158 that is bounded by rib 146 and shoe 142. First rib portion 150 and third rib portion 154 have dissimilar lengths such that a first end 160 of standoff 52 is nearer first buckle portion 40 than a second end 162 of standoff 52 is to either of first buckle portion 40 or second buckle portion 42. Preferably, shoe 142 curves about a lateral axis that is aligned with the operating direction of tabs 82, 84 so as to generally match the contour of the surface of the user that is proximate the location of intended usage of buckle assembly 22. Understandably, standoff 52 could have virtually any shape including planar shapes and/or convex shapes as compared to the concave shape as shown. Preferably, standoff 52 has a lateral or offset extension length, indicated by arrow 170 that is sufficient to allow passage of the user's fingertips beyond tab 82 and in a crossing direction relative to operating direction 88 so as to allow full engagement of the user's fingertips with tabs 82, 84 without generating a bypassing interference of the user's fingertips with the skin or tissue of the wearer. Shoe 142 also extends beyond a plane of engagement, indicated by line 172, associated with the non-overlapping and possibly abutting portions of first buckle portion 40 and second buckle portion 42 during engagement therebetween.

Figure 9:
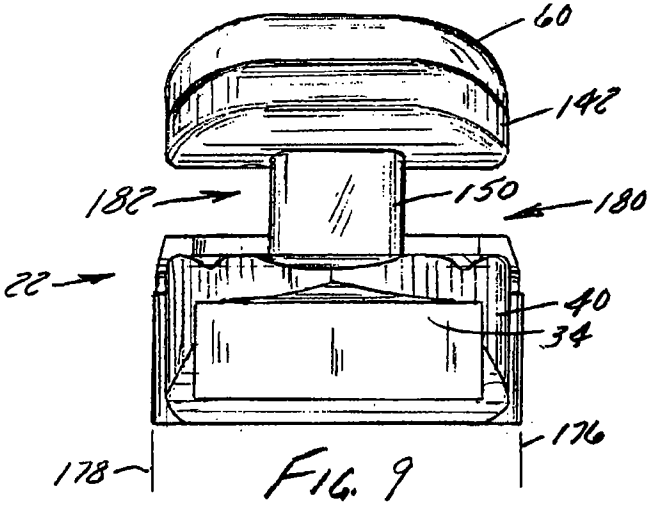
FIG. 9 is a side elevation view of an end of the buckle assembly shown in FIG. 5 opposite the end shown in FIG. 8.
Figure 8:
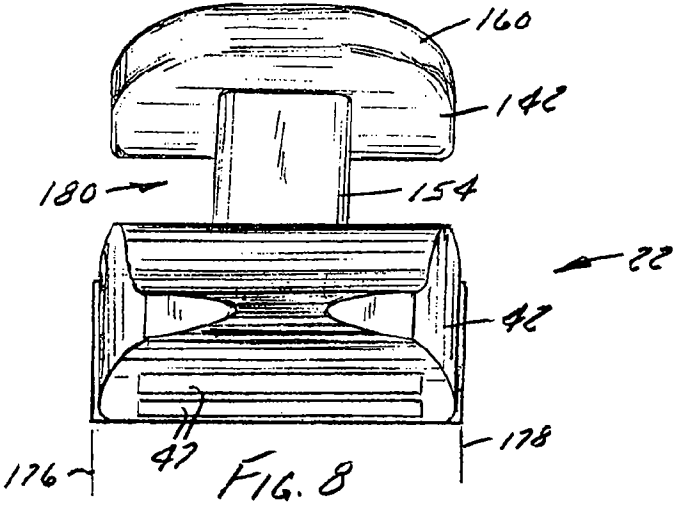
FIG. 8 is a side elevation view of an end of the buckle assembly shown in FIG. 5.

Referring to FIGS. 8 and 9, rib portions 150, 152, 154 are also offset laterally inward relative to lateral outboard edges, indicated by lines 176, 178 of first and second buckle portions 40, 42. Such a construction provides fingertip overlap areas 180, 182 wherein the user's fingertips can pass fully beyond first buckle portion 40 and second buckle portion 42 in a direction toward shoe 142 without creating an overlapping or abutting engagement with the fingertips of the user and the skin or tissues of the user positioned proximate buckle assembly 22. Such a construction provides for robust interaction with between the users fingers/thumb and tabs 82, 84 without interfering with the user's ability to manipulate or compress tabs 82, 84 toward one another during disengagement of first buckle portion 40 from second buckle portion 42.

Buckle assembly 22 provides a selectively operable closure assembly that reduces the potential of the wearer from being pinched by either the slidable engagement between the respective first and second buckle portions, being pinched by interaction of the fingers of the operator, or other who may be assisting the wearer, with tabs 82, 84, and negates the need to pull on the buckle assembly and/or the straps to create separation between the wearer and the operating structures of the buckle assembly to mitigate the potential for such unintended pinching actions. Buckle assembly 22 also reduces the footprint associated with that portion of the buckle assembly that is in direct contact with the skin of the wearer. Accordingly, buckle assembly 22 is both convenient to operate, not unduly uncomfortable if worn for extended periods of time and/or during strenuous activities, and mitigates the potential for pinching associated with both the slidable interaction between the first and second buckle portions 40, 42 and user interaction of the catch or latch systems associated therewith.

Therefore, one embodiment of the invention includes an apparel closure assembly having a first body and a second body that slidably cooperate with one another. A cavity and at least one opening are formed in the first body such that the at least one opening extends through the first body in an outward radial direction from the cavity. A portion of the second body is constructed to slidably cooperate with the cavity formed in the first body. A spring tab is connected to the second body by a living hinge and biased into engagement with the opening formed in the first body when the portion of the second body is disposed in the cavity. A standoff extends from one of the first body and the second body in an outward direction that is oriented in a crossing direction with respect to a movement direction of the spring tab and maintains a spacing between the first body, the second body, and the wearer.

Another embodiment of the invention that is combinable with one or more of the features of the above embodiment includes a snap buckle assembly having a first buckle portion and a second buckle portion. The second buckle portion slidably cooperates with the first buckle portion. A catch is flexibly connected to the second buckle portion and deflectable relative to the second buckle portion in a direction that crosses an operating direction associated with slidable cooperation between the first buckle portion and the second buckle portion. The catch is biased toward a secured engagement with the first buckle portion when the second buckle portion is fully engaged with the first buckle portion. An offset extends from one of the first buckle portion and the second buckle portion in a direction that crosses both a deflection direction of the catch and the operating direction of the first and second buckle portions.

Another embodiment of the invention that is combinable with one or more of the features of the above embodiments includes a method of forming a pitch resistant snap buckle assembly. A first clasp is attached to a strap and a second clasp is attached to at least one of the strap and another strap. A tab is formed on one of the first clasp and the second clasp and a pocket is formed on the other of the first clasp and the second clasp. The tab and the pocket are oriented so that the first clasp and second clasp snap-fittingly cooperate with one another to selectively connect the first clasp and the second clasp. A projection extends from at least one of the first clasp and the second clasp to form a gap between the first clasp and the second clasp and a wearer.

The present invention has been described above in terms of the preferred embodiment. It is recognized that various alternatives and modifications may be made to these embodiments which are within the scope of the appending claims.

What is claimed is:

1. An apparel closure assembly, comprising:

a first body;

a cavity and at least one opening formed in the first body, the opening extending in an outward radial direction through the first body from the cavity;

a second body wherein a portion of the second body is constructed to slidably cooperate with the cavity formed in the first body;

a spring tab connected to the second body by a living hinge and biased into engagement with the opening formed in the first body when the portion of the second body is disposed in the cavity; and a rigid standoff extending from the first body in an outward direction that is oriented in a crossing direction with respect to a movement direction of the spring tab;

wherein:

the standoff includes a rigid concave exterior surface opposite the first body;

the concave exterior surface extends pasta first end of the first body; and the concave exterior surface extends past a second end of the first body that is opposite the first end in an operating direction.

2. The assembly of claim 1, further comprising a strap connected to each of the first body and the second body.

3. The assembly of claim 2, wherein a portion of the strap that is offset from at least one of the first body and the second body is secured to a bicycle helmet.

4. The closure assembly of claim 1, further comprising another opening that extends through the first body in an opposite direction relative to the at least one opening.

5. The closure assembly of claim 1, wherein the concave exterior surface is a shoe, the standoff further includes a web wall separating the shoe and the first body, and the shoe extends in a crossing direction relative to a longitudinal axis of the standoff.

6. The closure assembly of claim 5, further comprising a pad attached to the shoe and configured to be adjacent to an anatomy of a wearer.

7. A snap buckle assembly, comprising:

a first buckle portion;

a second buckle portion that slidably cooperates with the first buckle portion;

a catch flexibly connected to the second buckle portion and deflectable relative to the second buckle portion in a direction that crosses an operating direction associated with slidable cooperation between the first buckle portion and the second buckle portion, the catch biased toward a secured engagement with the first buckle portion when the second buckle portion is fully engaged with the first buckle portion; and an offset that extends from the first buckle portion in a direction that crosses both a deflection direction of the catch and the operating direction of the first and second buckle portions;

wherein:

the offset is rigid and includes a concave exterior surface that is rigid and opposite the first buckle portion;

the concave exterior surface extends past a first end of the first buckle portion; and the concave exterior surface extends past a second end of the first buckle portion that is opposite the first end in an operating direction.

8. The assembly of claim 7, wherein the first buckle portion and the second buckle portion are connected to a bicycle helmet.

9. The assembly of claim 8, further comprising a first strap that extends between the first buckle portion and the bicycle helmet; and a second strap that extends between the second buckle portion and the bicycle helmet.

10. The assembly of claim 7, further comprising another catch flexibly connected to the second buckle portion and deflectable relative to the second buckle portion in a direction aligned with the direction of deflection of the catch so that inward deflection of the catch and another catch is required to disengage the first buckle portion from the second buckle portion.

11. The assembly of claim 7, wherein the offset includes a first portion that extends in the direction that crosses both the deflection direction and the operating direction and a second portion that extends in a crossing direction relative to the first portion.

12. The assembly of claim 11, further comprising a pad attached to a side of the second portion of the offset that is opposite the first portion.

13. The assembly of claim 11, wherein the second portion of the offset has distal ends that curve away from the one of the first buckle portion and the second buckle portion and is configured to contour to an anatomy of a user.

14. The assembly of claim 11, wherein the offset has a longitudinal length that is aligned with the operating direction and includes a pair of longitudinal ends that having different lengths.

15. A method of forming a pinch resistant snap buckle assembly, comprising:

attaching a first clasp to a strap;

attaching a second clasp to at least one of the strap and another strap;

forming a tab on one of the first clasp and the second clasp and forming a pocket on the other of the first clasp and the second clasp and orienting the tab and the pocket so that the first clasp and second clasp snap-fittingly cooperate with one another to selectively connect the first clasp and the second clasp; and forming a projection on the first clasp;

wherein:

the projection is rigid and includes a concave exterior surface that is rigid and opposite the first clasp;

the concave exterior surface extends past a first end of the first clasp; and the concave exterior surface extends past a second end of the first clasp that is opposite the first end in an operating direction.

16. The method of claim 15, further comprising forming another tab opposite the tab on the one of the first clasp and the second clasp.

17. The method of claim 15, further comprising securing the strap and the at least one of the strap and another strap of the first clasp and the second clasp to a bicycle helmet.

18. The method of claim 15, further comprising extending a first end of the projection further from the one of the first clasp and the second clasp than a second end of the projection.

19. The method of claim 15, further comprising forming a shoe on the end of the projection opposite the one of the first clasp and the second clasp so that the shoe is configured to be adjacent the wearer.

20. The method of claim 15, further comprising selecting a distance of the gap to allow operation of the tab by a user without compressing anatomy adjacent the tab in a direction toward a longitudinal centerline of the buckle assembly.

* * * * *